United States Patent [19]

Ärneteg

[11] Patent Number: 4,617,867

[45] Date of Patent: Oct. 21, 1986

[54] TROLLEY BRACKET

[75] Inventor: Ingemar Ärneteg, Vretstorp, Sweden

[73] Assignee: Stellana Plast AB, Sweden

[21] Appl. No.: 670,028

[22] Filed: Nov. 9, 1984

[30] Foreign Application Priority Data

Nov. 25, 1983 [SE] Sweden ..... 8306515

[51] Int. Cl.[4] ..... B61B 3/00; A47H 13/10

[52] U.S. Cl. ..... 105/154; 16/98; 16/102

[58] Field of Search ..... 105/154, 148, 150; 16/97, 98, 102; 104/89, 93, 95; 446/228, 229, 279

[56] References Cited

U.S. PATENT DOCUMENTS

| | | | |
|---|---|---|---|
| 2,250,167 | 7/1941 | Niles et al. | 105/154 |
| 2,584,610 | 2/1952 | Pearson | 105/154 |
| 3,293,685 | 12/1966 | Rosenbaum | 16/98 X |
| 4,248,157 | 2/1981 | Evans | 105/154 |
| 4,384,387 | 5/1983 | Pachuta | 105/150 X |
| 4,433,627 | 2/1984 | Forshee | 105/154 X |

*Primary Examiner*—Robert B. Reeves
*Assistant Examiner*—David F. Hubbuch
*Attorney, Agent, or Firm*—Larson & Taylor

[57] ABSTRACT

A trolley bracket comprises at least one element (3', 3'') which comprises a pivot (8) for receiving a wheel (2) movable along a guide (1) and rotatable by way of a bearing (5), and a member (9) hanging down from the pivot and having an element (10) for connecting the element to an object to be carried by the bracket. The pivot (8) and the hanging member (9) are formed as an integral piece from plastic, e.g. injection-moulded, fibre-reinforced polyamide.

5 Claims, 5 Drawing Figures

TROLLEY BRACKET

TECHNICAL FIELD OF THE INVENTION

The present invention relates to a trolley bracket with at least one element which comprises a pivot for receiving a wheel movable along a guide and rotatable by means of a bearing, and a member hanging down from the pivot and having means for connecting the member to an object, for instance a chain, to be supported by the bracket.

BACKGROUND OF THE INVENTION

Conventional trolley brackets of the above-mentioned type, which are used in the industry in different types of conveyor systems, comprise two identical halves or elements which are each composed of a hanging member, for instance of plastic, and a separate pivot of metal which is mounted in a hole in the hanging member by means of a nut and a plurality of washers. The fact that the pivot and the hanging member are separate units in actual practice makes the trolley bracket expensive to manufacture, partly because of high costs of material, partly because of the labour costs involved in the assembly of the different components. An example of such trolley brackets is disclosed in U.S. patent specification No. 4262796.

BRIEF DESCRIPTION OF THE INVENTIVE CONCEPT

The present invention aims at providing a trolley bracket of the above-mentioned type which is of a simpler design and less expensive. According to the invention, this object is achieved in that the pivot and the hanging member are formed as an integral piece from plastic, e.g. injection-moulded, fibre-reinforced polyamide, and that the pivot is in the form of a cylindrical shell having an outer diameter which substantially corresponds to the inner diameter of the bearing of the wheel, such that the bearing can be directly applied to the pivot.

BRIEF DESCRIPTION OF ACCOMPANYING DRAWINGS

In the drawings,

FIG. 1 is a part-sectional perspective view illustrating the bracket according to the invention associated with a guide, FIGS. 2 and 3 are perspective views which from opposite directions show one half of the bracket, FIG. 4 is a side view of such a bracket half, and FIG. 5 is a section thereof.

DETAILED DESCRIPTION OF A PREFERRED EMBODIMENT OF THE INVENTION

Figure 1:
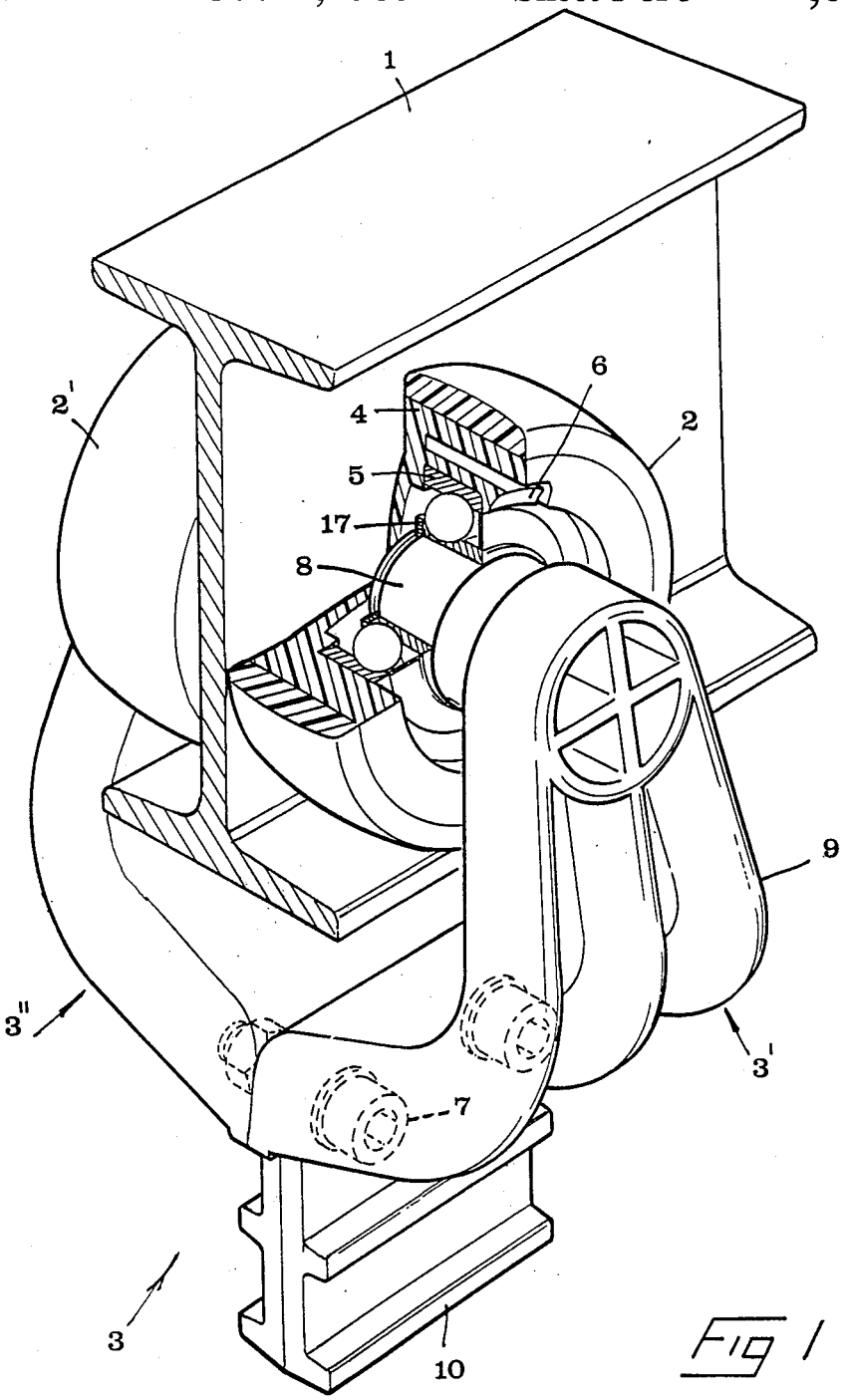
Figure 2:
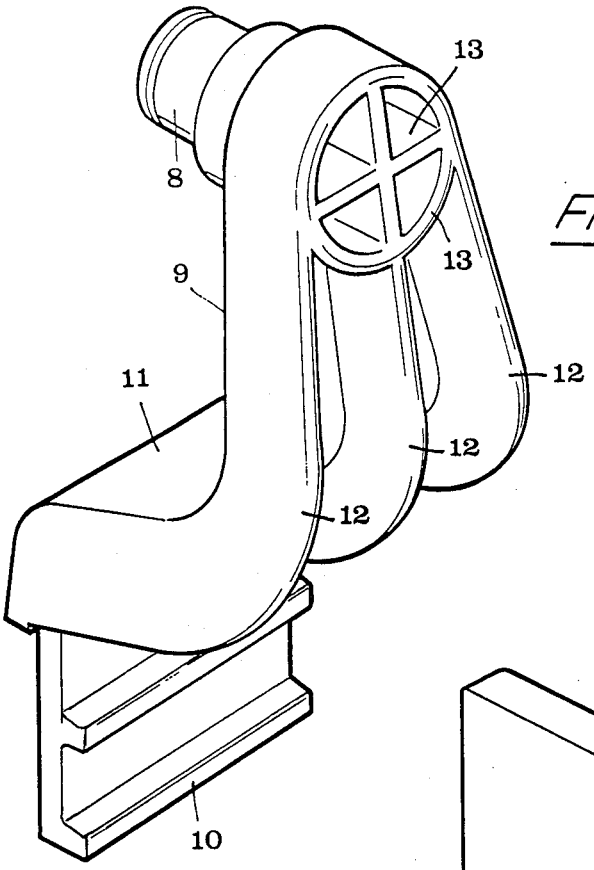
Figure 3:
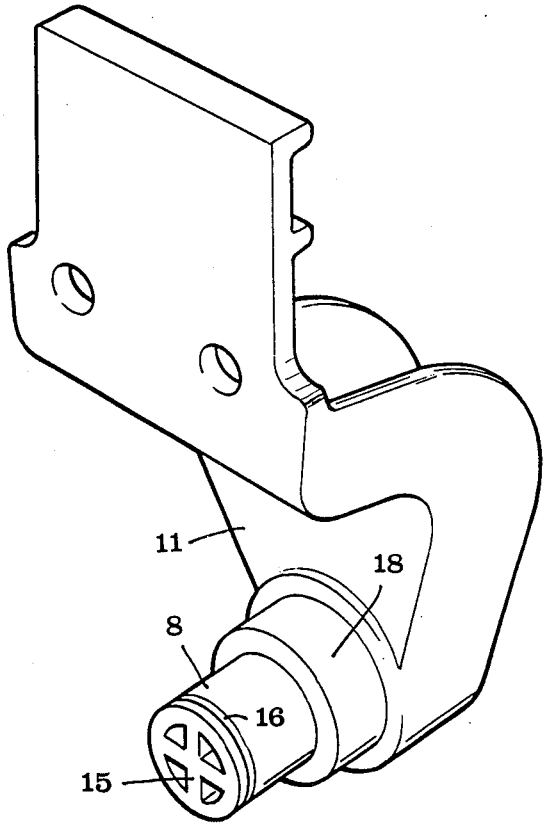
Figure 4:
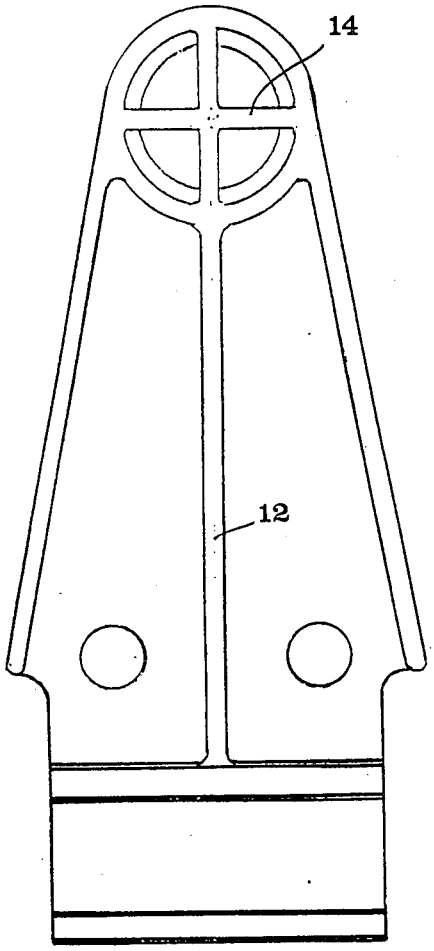
Figure 5:
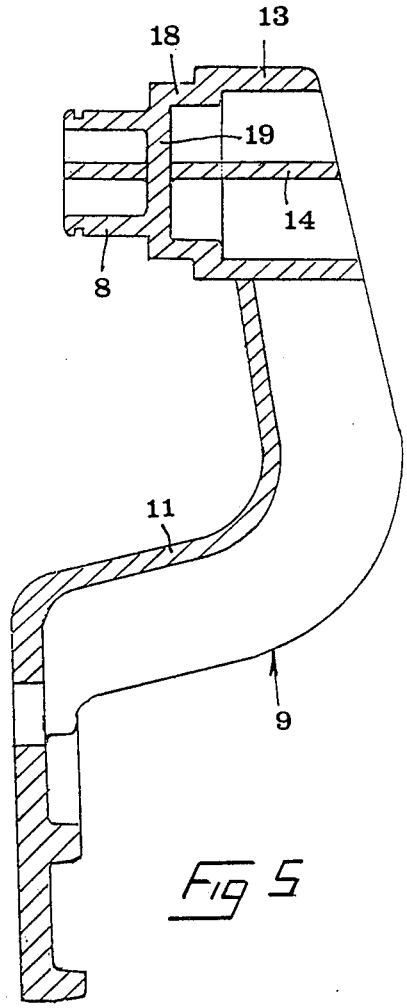

In FIG. 1, 1 designates an I-beam which serves as a guide and along the lower flanges of which two wheels 2, 2' roll, which carry a bracket according to the invention generally designated 3. These wheels may advantageously be designed in the manner disclosed in SE patent application No. 8305120-1 and comprise an annular body of plastic 4 and a bearing 5 which is maintained in position in a cavity in the body 4 by means of elastically yieldable snap-action fingers 6.

The trolley bracket 3 according to the invention comprises two identical halves or elements 3', 3'' which are held together by means of a number of bolts 7 provided with nuts. As appears from FIGS. 2–5, each half comprises a pivot 8 which, when mounted, is substantially horizontal, and a member 9 hanging down from the pivot and at its lower end provided with means, in this case two strips or rails 10, for suspending the object (not shown) to be carried by the bracket. In practice, the illustrated embodiment of the bracket should carry a chain.

The hanging member 9 comprises a substantially L-shaped structural wall 11 whose outer side is provided with three vertical or longitudinal stiffening ribs 12 which, at the top, merge into a common cylindrical shell 13 within which there are provided four reinforcing flanges 14 extending radially outwards from a centre. Also the pivot 8 located on the opposite side of the structural wall 11 with respect to the shell 13 is in the form of a cylindrical shell within which four radial reinforcing flanges 15 are provided. At its outer end, the pivot 8 has a circumferential groove 16 for receiving a locking washer 17 (see FIG. 1) for locking the bearing 5 on the pivot. From FIGS. 3 and 5 it appears that the pivot 8 at its inner end merges into a shoulder 18 which, in turn, merges into the shell 13. The outer diameter of the pivot 8 is equal to the inner diameter of the bearing 5 so that this can be applied directly to the pivot.

According to the principle of the invention, the illustrated element 3' (and 3'') is formed as an integral piece from plastic, suitably glass fibre reinforced polyamide which is injection-moulded in a suitable tool. According to a characteristic feature of the invention, the structural wall 11, the stiffening ribs 12, the two shells 8 and 13, and the reinforcing flanges 15 and 14, respectively, provided therein have substantially the same wall or material thickness, in actual practice about 2–3 mm. Also the partition 19 (see FIG. 5) which is provided at the inner end of the pivot or shell 8 has a thickness of this order of magnitude. It will hereby be ensured that all portions of said elements will set substantially at the same time and extremely quickly in connection with the injection moulding. By the small material thickness in all portions it is also possible to avoid any undesired formation of blisters or voids in the plastic during this process. The small thickness of the material has been achieved while maintaining a very high strength of the element thanks to the constructional design of the stiffening ribs 12 and the reinforcing flanges 14 and 15 as illustrated.

The bracket 3 shown in FIG. 1 is mounted on the beam 1 in the following way. In a first step, each of the bearings 5 is applied to the respective pivot 8 and secured thereto by means of the locking washer 17. The wheel body 4 is thereafter placed on the bearing 5 and snapped onto it by means of the yielding fingers 6. In a final step, the two elements or halves 3', 3'' are joined by means of the bolts 7, whereupon the bracket is ready for use.

POSSIBLE MODIFICATIONS OF THE INVENTION

It goes without saying that the invention is not restricted only to the embodiment described above and illustrated in the drawings. Thus, it is possible, without departing from the spirit and scope of the invention, to design a bracket which comprises a single element provided with a wheel instead of two elements interconnected by means of bolts 7. The essential thing is that the hanging member and the pivot of each element are designed as an integral piece. Further, instead of the strips or rails 10 it is possible to use any other means for suspending the contemplated object, such as hooks or rings.

I claim:

1. A trolley bracket with at least one element which comprises a pivot for receiving a wheel movable along a guide and rotatable by means of a bearing and a member hanging down from the pivot and having means for connecting the element to an object to be supported by the bracket, wherein the pivot and the hanging member are formed as an integral piece from plastic, the pivot being in the form of a first cylindrical shell having an outer diameter which substantially corresponds to the inner diameter of the bearing of the wheel, such that the bearing can be directly applied to the pivot, and wherein the hanging member comprises a substantially L-shaped structural wall whose outer side is provided with a plurality of longitudinal stiffening ribs which, at the top, merge into a second cylindrical shell located at the side of the structural wall opposite to the first-mentioned pivot-forming shell, said structural wall, said stiffening ribs and said two cylindrical shells having substantially the same wall thickness.

2. A trolley bracket according to claim 1, wherein the plastic is an injection-molded piece.

3. A trolley bracket according to claim 1, wherein the plastic is fiber reinforced polyamide.

4. A trolley bracket according to claim 1, wherein the pivot, at its free end remote from the hanging member has a circumferential groove for a locking washer for locking the bearing on the pivot.

5. A trolley bracket according to claim 1, wherein at least one of said cylindrical shells includes radial reinforcing flanges having substantially the same thickness as the cylindrical shells.

* * * * *